US005135449A

United States Patent [19]

Jones

[11] Patent Number: 5,135,449

[45] Date of Patent: Aug. 4, 1992

[54] ROWING EXERCISE MACHINE

[75] Inventor: Gary A. Jones, Falmouth, Ky.

[73] Assignee: Hammer Strength Corporation, Cincinnati, Ohio

[21] Appl. No.: 586,426

[22] Filed: Sep. 21, 1990

[51] Int. Cl.[5] ..... A63B 69/06

[52] U.S. Cl. ..... 482/72; 482/97; 482/134; 482/136; 482/137

[58] Field of Search ..... 272/72, 134, 118, 117; 272/118, 117

[56] References Cited

U.S. PATENT DOCUMENTS

| | | | |
|---|---|---|---|
| 3,858,873 | 1/1975 | Jones . | |
| 3,998,454 | 12/1976 | Jones . | |
| 4,239,210 | 12/1980 | Lambert, Jr. | 272/118 |
| 4,563,003 | 1/1986 | Bugallo et al. | 272/134 X |
| 4,603,855 | 8/1986 | Sebelle | 272/118 X |
| 4,614,338 | 9/1986 | Castillo | 272/117 |
| 4,635,926 | 1/1987 | Minkow | 272/118 |
| 4,720,099 | 1/1988 | Carlson . | |
| 4,722,522 | 2/1988 | Lundgren | 272/134 X |
| 4,966,363 | 10/1990 | van der Hoeven | 272/134 X |

FOREIGN PATENT DOCUMENTS

| | | | |
|---|---|---|---|
| 2170413 | 8/1986 | United Kingdom | 272/118 |

OTHER PUBLICATIONS

"Cybex" Brochure; Dec. 1989; 6 pages.
"Dynamics" Brochure; Sep. 1979; 6 pages.
Brochure "Leverage Machines" by Nautilus®, Instruction Manual, p. 17, 1989.

*Primary Examiner*—Richard J. Apley
*Assistant Examiner*—D. F. Crosby
*Attorney, Agent, or Firm*—Wood, Herron & Evans

[57] ABSTRACT

A rowing exercise machine includes a frame, a seat and a chest brace supported by the frame, and a pair of levers pivotally connected to the frame in front of the brace and seat. Each of the levers has a lower end adapted to support at least one removable weight and a handle at an upper end adapted to be grasped by an exerciser supported on the seat. During the performance of a rowing exercise, the exerciser pulls the handles upwardly and rearwardly to pivot the levers against the weight resistances held by the lower ends. The levers move along two outer vertical planes that converge with respect to the forward direction of the seat, and each of the levers pivots independently with respect to the frame.

15 Claims, 5 Drawing Sheets

ROWING EXERCISE MACHINE

FIELD OF THE INVENTION

This invention relates to an improved rowing exercise machine that accommodates the musculoskeletal makeup of a person.

BACKGROUND OF THE INVENTION

Many athletes and non-athletes utilize weight lifting or weight training exercises to build strength and/or bulk, to prevent injury, or to improve overall condition and appearance. Typically, weight training exercises are performed with either exercise machines or free weights, i.e., barbells and weighted plates, dumbbells, etc. For various reasons, most exercise programs incorporate both machines and free weights in a variety of different exercise routines in order to maximize the effect of working out a desired number of muscle groups.

On one hand, free weights offer a number of advantages over exercise machines. For one, they are relatively inexpensive in comparison. Free weights are also more versatile because a variety of exercises can be performed with one set of weights, whereas most exercise machines are designed for only one exercise. For those exercise machines which do provide for more than one exercise, cost usually increases proportionately with the number of exercises. Another advantage may be more psychological than actual, but many "power" lifters simply prefer the lifting and moving of heavy weighted plates, or the "feel" of free weights. Finally, free weights are popular among many weight lifters because the lifting movements are not restricted to prescribed planes of motion and at prescribed angles determined by a machine.

However, there are a number of inherent disadvantages associated with free weights. One such disadvantage relates to safety. Although most weight room instructors strongly advise against an individual working out by himself or herself, this cautionary measure is particularly important when the lifting of free weights is involved. This is due to commonly recognized dangers such as the possibility of dropping a weight on a body part, or becoming trapped beneath a bar, which could easily occur in exercises such as bench press, incline press or squat. Additionally, through carelessness, loading and unloading of heavy weighted plates onto the ends of a bar sometimes results in an unbalanced bar that falls downward from its rack.

For this reason, a number of "leverage" machines have been developed over the past few years in an effort to combine the safety advantages of an exercise machine with the feel and psychological "lift" provided by free weights. One such machine is referred to as a rowing exercise machine. This enables an exerciser to perform an exercise commonly referred to as a "rowing exercise." While supported upon a seat connected to a frame, the exerciser leans forward and grasps the two handles of a lever which holds a barbell with weighted plates. By pulling the handles rearwardly, the weight is pivoted upwardly, toward the exerciser.

While this lever rowing exercise machine represents an advantage over the prior alternative, that of performing a rowing exercise without the benefit of a machine and at greater injury risk, even this lever rowing exercise machine suffers from a subtle disadvantage that most weight lifters apparently have assumed to be inherent with all exercise machines. That is, the planes and angles of prescribed movement do not seem quite right in relation to the musculoskeletal structure of a normal person. In short, this lever rowing exercise machine does not seem to "fit" the human body. As a result, some individuals experience excessive joint stress or compression from use of this machine, or machines of this type.

Moreover, although the prior lever rowing exercise machine could be used to exercise one arm at a time, it was not designed specifically for that purpose. As a result, performance of one-handed rowing exercise on this machine may even further accentuate the awkwardness that is felt by an exerciser. This is particularly disadvantageous during rehabilitation, when it is often desirable to monitor and compare the relative strength of a previously injured, recovering limb with a healthy limb.

It is therefore an object of the invention to provide an improved rowing exercise machine which, compared to prior machines, more naturally accommodates the musculoskeletal movements of a person's body.

It is another object of the invention to provide an improved rowing exercise machine that maximizes the exercise benefit attainable during a rowing motion while minimizing skeletal or joint stress.

It is still another object of the invention to provide an improved rowing exercise machine with increased versatility in exercising one arm at a time.

SUMMARY OF THE INVENTION

This invention contemplates a rowing exercise machine with a frame, a seat supported by the frame and two, independently movable levers that are pivotally connected to the frame in front of the seat. The ends of the levers have handles that are grasped and pulled rearwardly, either independently or simultaneously, to pivotally raise, with respect to the frame, weighted plates supported on hubs at the lower ends of the levers.

The frame has sides that converge toward the front of the machine and diverge in the rearward direction. The levers are mounted to the converging frame sides and move through corresponding, forward converging planes. When compared to prior rowing exercise machines, the outer planes of movement of this machine more naturally accommodate the musculoskeletal structure of the human body. Moreover, by providing two independently operable levers that are designed to match the natural movement of muscles of one side with respect to the entire body, this improved rowing exercise machine is particularly suitable for rehabilitation after an injury.

In accordance with the objects of this invention, a rowing exercise machine preferably includes a frame, a seat and a forwardly declined support brace connected to the frame and two levers, each lever pivotally connected to a forwardly converging side of the frame. Each lever has a handle located at its upper end and a weight supporting hub connected to a lower end. The lever pivot axes are located above and in front of the seat and are perpendicular to their respective sides of the frame. When the handles are grasped and pulled rearwardly and upwardly, the arcuate paths traversed by the handles and the levers lie along vertical planes that diverge rearwardly with respect to the seat.

Initially, when the levers are at rest, the handles are closest to one another, and they move farther apart as the rowing motion progresses. The angled orientation of the levers and the handles with respect to the forward facing direction of the seat, along with the declined angle of the chest brace, places the exerciser in a natural position for coupling the applied pulling motion of the rowing exercise along two outer planes of motion that seem to more naturally accommodate the structure of the human body, relative to this maneuver. As a result, a person supported on the seat is able to maximize the muscular benefits during a rowing motion.

The evolution of this rowing exercise machine resulted from years of study, by the inventor, of athletic movements of the body relative to commonly performed weight training maneuvers. Based on his observations and experience in both fields, he concluded that most athletic movements involve compound motion of multiple joints, while exercise machines are designed for movements that are perpendicular or parallel to the torso. According to this view, most exercise machines oversimplify the body's movements, and there is a genuine need for improvement. Based upon feedback from athletes and other individuals involved in weight training, the rowing exercise machine of this invention constitutes a significant improvement over prior rowing machines.

This rowing exercise machine provides the benefits of both free weights and exercise machines without the attendant disadvantages commonly associated with either of these methods of exercising.

For this rowing exercise machine, the resistance variation through the course of the rowing movement is similar to the resistance variation provided by the prior lever type rowing machine. However, it is not identical. The angles and lengths of the forward ends of the levers and the locations of the pivot axes with respect to the seat and the chest brace have been structurally arranged to make it slightly easier to initiate the rearward rowing motion, and slightly more difficult to continue movement once the motion has been initiated, and then easier again at the end of the motion. This compensates for the initial acceleration that is required to commence the pulling force and the reduction in force caused by the momentum of a moving lever, and a terminal deceleration at the end of the movement. This differs from the one known prior lever rowing machine, which seems to become progressively more difficult through the rowing motion.

These and other features of the invention will be more readily understood in view of the following detailed description and the drawings in which:

DETAILED DESCRIPTION OF THE DRAWINGS

Figure 1:
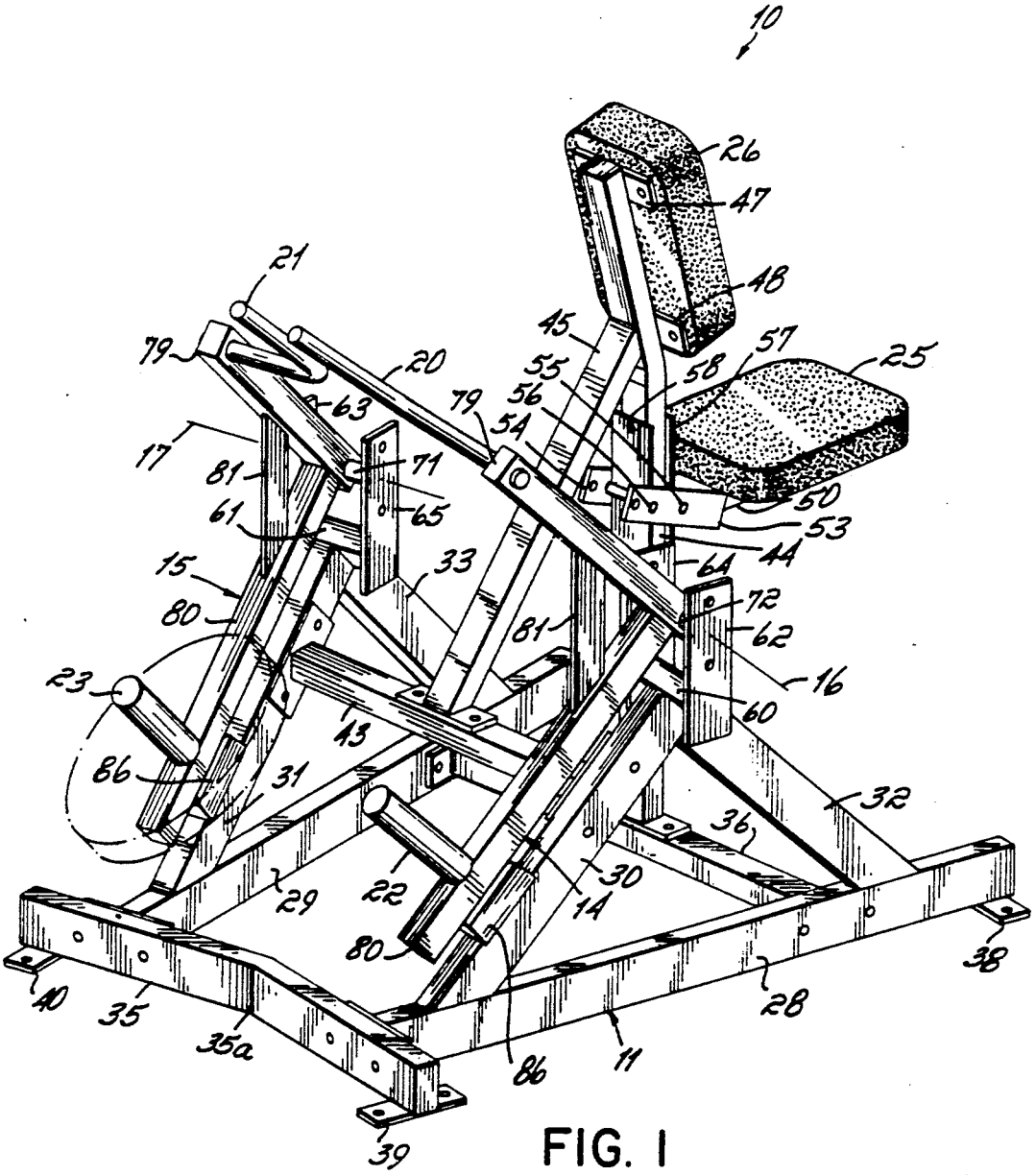
FIG. 1 is a perspective view of a rowing exercise machine in accordance with a preferred embodiment of the invention.

FIGS. 1–4 show a rowing exercise machine 10 in accordance with the preferred embodiment of the invention. Machine 10 includes a frame 11 made of a number of straight and/or curved sections of heavy duty steel that are either welded or bolted together, or pivotally connected. Exercise levers 14 and 15 are pivotally connected to the frame 11 and pivot about pivot axes 16 and 17, respectively. An exerciser 18 (see FIG. 5) grasps handles 20 and 21 to pivot levers 14 and 15 in an upward direction. When grasping, the palms of the exerciser 18 face inwardly, perpendicular to the forward facing direction of the exerciser 18, and the thumbs point in an upward direction. The lower ends of the levers 14 and 15 include hubs 22 and 23, respectively, which are adapted to hold one or more removable weights 24.

During the performance of a rowing exercise on this machine 10, the exerciser 18 is supported on a seat 25 that is connected to the frame 11. While supported on the seat 25 in a direction facing the levers 14 and 15, the exerciser 18 leans forwardly against the chest brace 26 and pulls the levers rearwardly against the weight supported upon the hubs 22 and 23, respectively.

Figure 2:
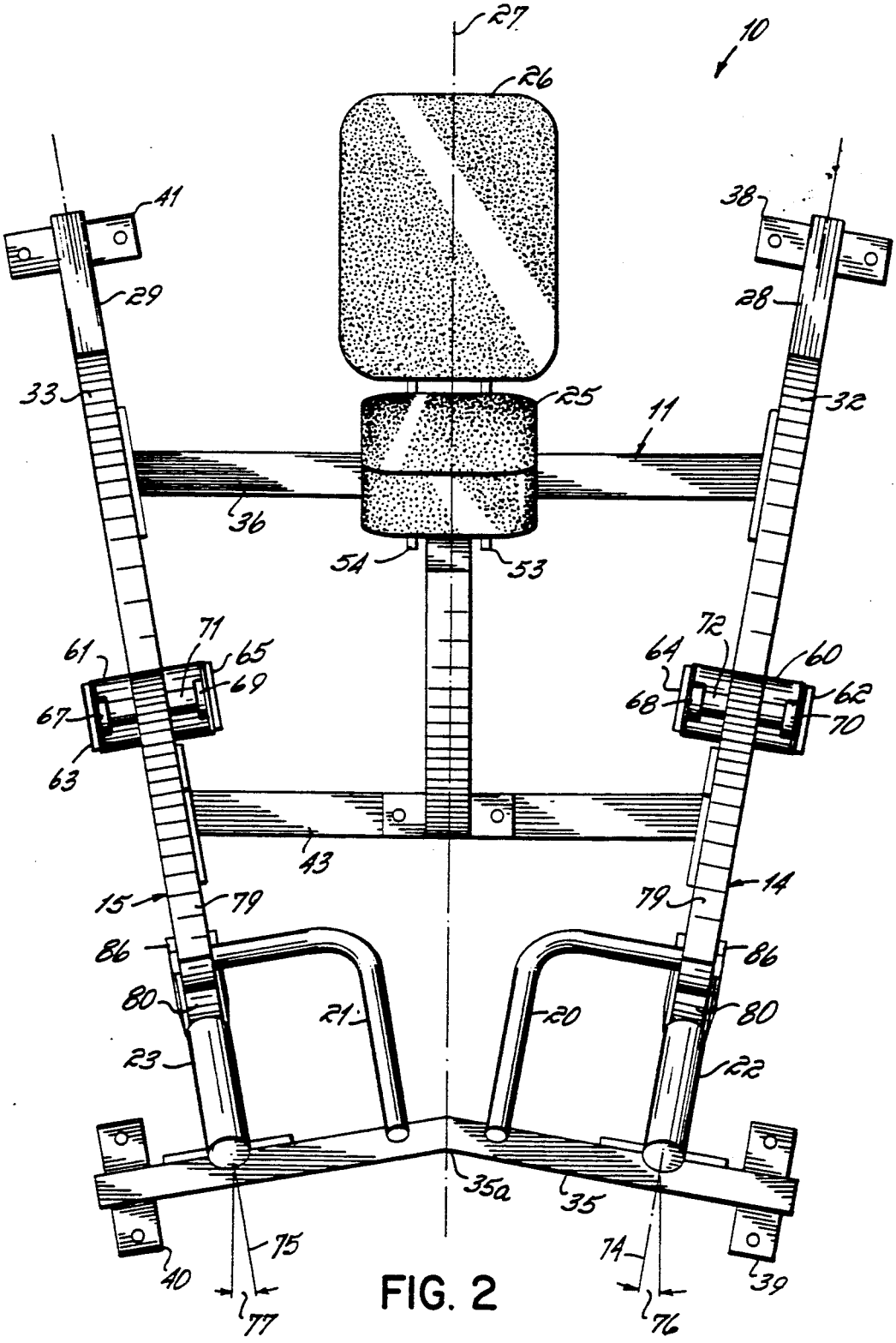
FIG. 2 is a top view of the exercise machine shown in FIG. 1, with both exercise levers located in an at rest position.

The frame 11 is longitudinally symmetric about a vertical midplane 27, shown more clearly in FIG. 2. Each side of the frame 11 includes bottom support that is connected to and supportive of front and rear legs. As shown in FIG. 1, bottom leg 28 is connected to, and supports front leg 30 and rear leg 32 on the left side of the machine, as viewed by an exerciser 18 supported on seat 25. Similarly, the right side of the machine includes bottom support 29 and front leg 31 and rear leg 33.

A front brace 35 connects the forward ends of bottom supports 28 and 29. The front brace 34 includes a centrally located bend **35*a* where it intersects vertical midplane 27. A rear brace 36 also connects bottom supports 28 and 29. As shown in FIG. 1, the ends of rear brace 36, and the forward ends of bottom supports 28 and 29 have plates welded thereon, with bolts (not shown) extending therethrough to provide connection. Preferably, the frame 11 is supported upon outer plates 38, 39, 40 and 41 (FIG. 2) welded to the outermost corners of the machine. Bolt holes through these plates enable the machine 10** to be secured in place, or secured to a removable frame during transportation.

A lateral brace 43 extends through midplane 27 and is connected to inside surfaces of front legs 30 and 31. An upright 44 extends upwardly from rear brace 36. The upright 44 supports both the seat 25 and the brace 26. For additional stability, a diagonal brace 45 extends between lateral brace 43 and upright 44. As shown more clearly in FIG. 3, upright 44 bends forwardly at point 46 between seat 25 and chest brace 26. Chest brace 26 is connected to the upper end of upright 44 by welded plates 47 and 48, preferably declining forwardly at an angle of about 15°. The seat 25 is supported upon arm 50 which is rigidly connected between plates 53 and 54. Plates 53 and 54 are connected to each other by a pair of spaced rods 55 and 56 that frictionally engage a pair of spaced pads 57 and 58 mounted to upright 44. This enables seat 2 to be vertically adjustable along upright 44 to accommodate different heights.

Figure 4:
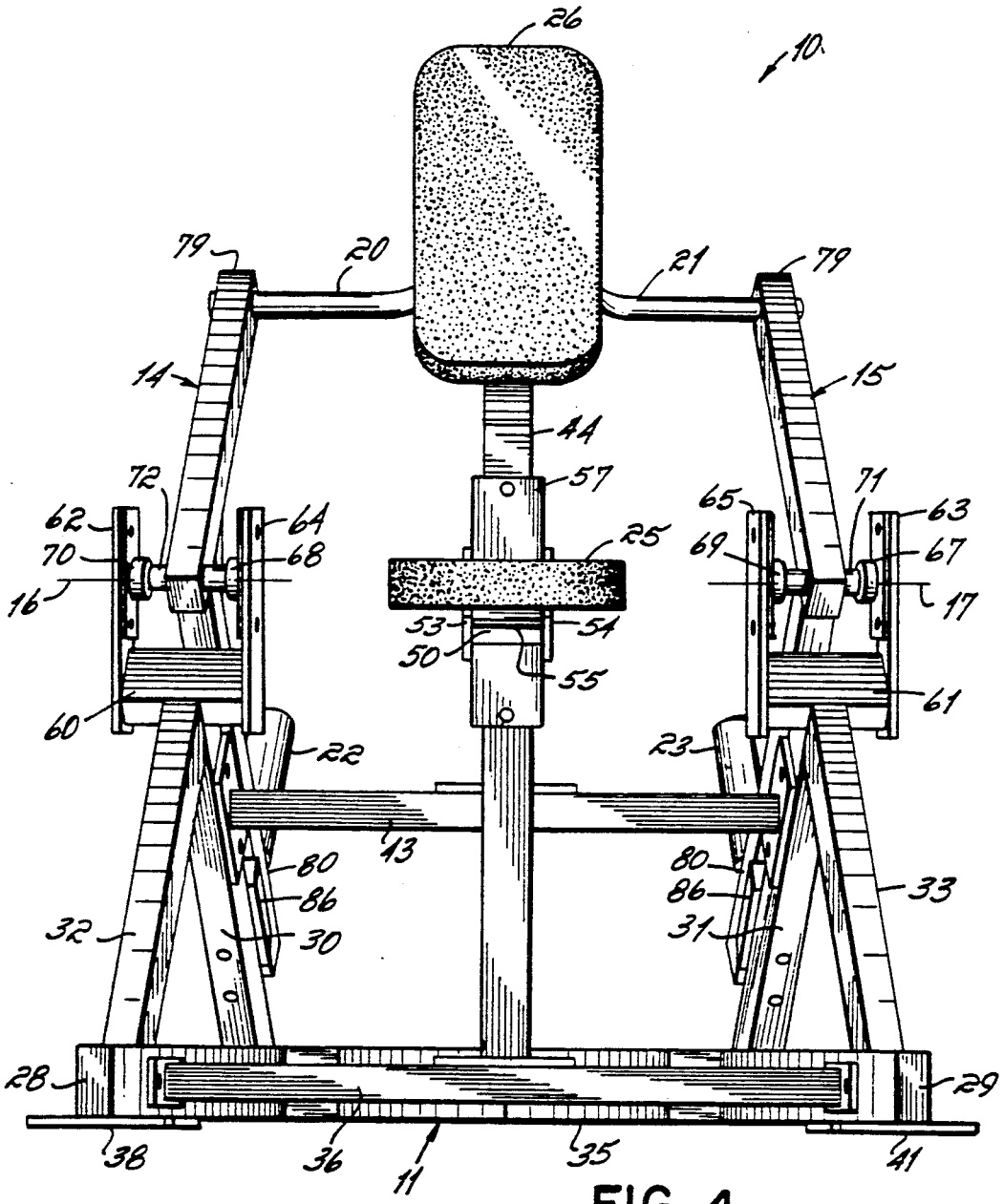
FIG. 4 is a rear view of the rowing exercise machine shown in FIG. 2.

A connective structure for pivotally supporting the levers 14 and 15 are located, on each side of the frame, where the front and rear legs contact each other. As best shown in FIG. 4, on the left side of the frame, a horizontally oriented support 60 connected between the upper ends of front leg 30 and rear leg 32. A pair of plates 62 and 64 are rigidly connected to the ends of the support 60. The plates 62 and 64 extend upwardly, and have bearings 68 and 70 connected to facing surfaces thereof along axis 16. An axle 72 rigidly connected to lever 14 seats within the bearings 68 and 70 to render the lever 14 pivotal about axis 16. Similarly, on the right side of the frame, horizontal support 61 is connected to front leg 31 and rear leg 33. Plates 63 and 65 are rigidly connected to the ends of support 61 and extend upwardly therefrom. Inwardly directed surfaces of plates 63 and 65 have bearings 67 and 69 connected thereto, along axis 17. An axle 71 rigidly connected to lever 15 is seated within the bearings to render lever 15 pivotal with respect to the frame.

As shown most clearly in FIG. 2, levers 14 and 15 pivot along outer planes 74 and 75, respectively, that converge with respect to the forward direction of the frame 11. Thus, for an exerciser 18 supported on the seat 25, levers 14 and 15 are pulled rearwardly and outwardly during performance of a rowing exercise. Numerals 76 and 77 designate the angles of convergence of planes 74 and 75 with respect to frame 11. Preferably, this angle is about 10°.

Figure 3:
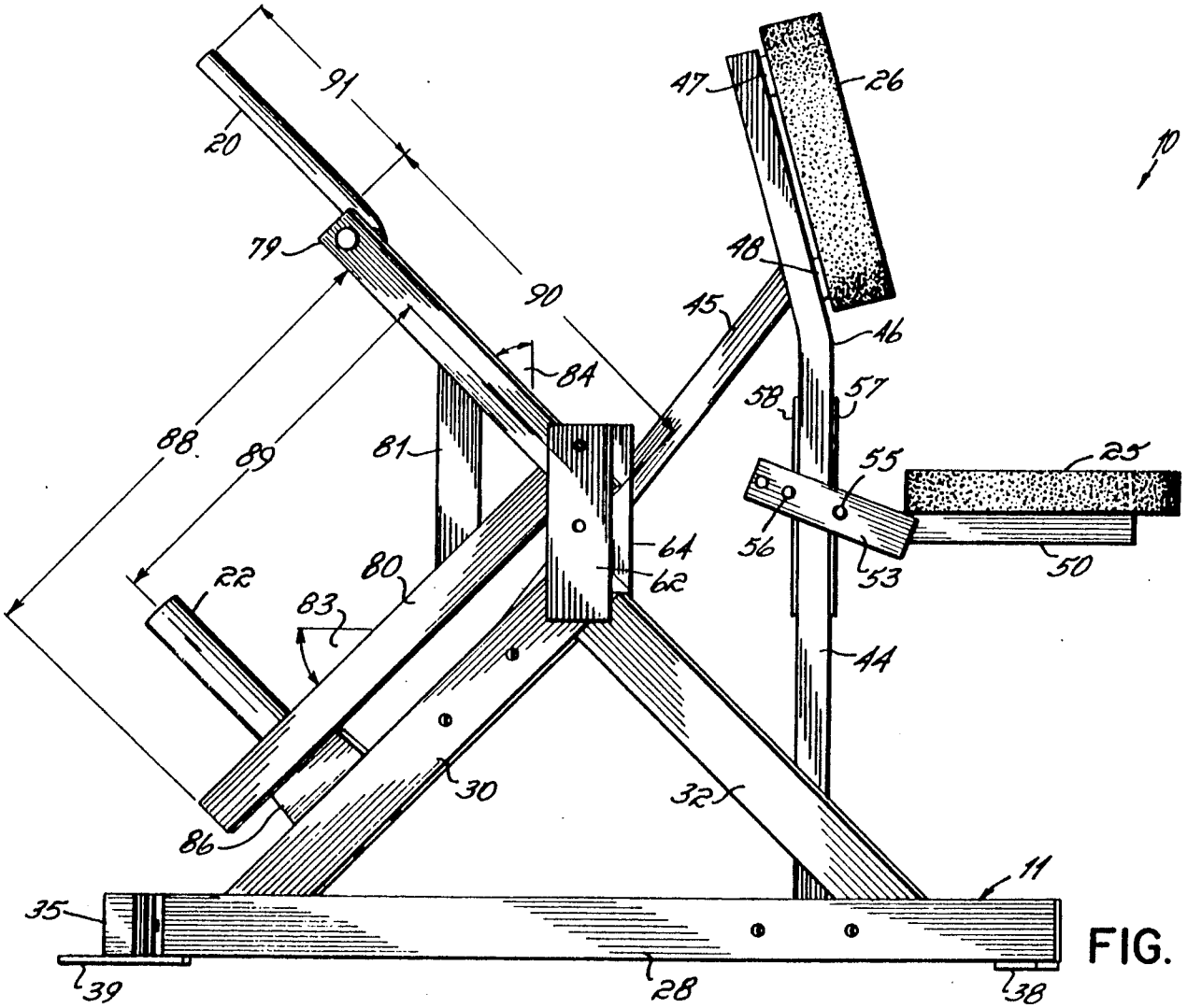
FIG. 3 is a side view of the rowing exercise machine shown in FIG. 2.

As shown in FIG. 3, lever 14 includes an upper member 79 rigidly connected to a lower member 80. A diagonally connected brace 81 provides additional stability between members 79 and 80. Preferably, the angle of connection between member 79 and member 80 is about 90°. In an initial at rest position, lower member 80 resides at an angle removed from horizontal of about 45°, designated by numeral 83. Thus, upper member 79 is displaced from vertical plane at an angle designated by numeral 84, which is also about 45°. To prevent metal-to-metal contact between lever 14 and the frame 11, a pad 86 is connected to front leg 30. Although not shown, lever 15 includes the same parts, with the same dimensions and the same angles of orientation. Lower member 80 preferably has a length 88 of about 23', and the distance 89 between the pivot axis 16 and hub 22 is about 19. The member 79 extends a length of about 19", designated by numeral 90, and handle 20 extends an additional length of about 10.5", designated by numeral 91.

As shown in FIG. 2, each handle comprises a bar welded to the upper member of the respective lever. The bar extends inwardly toward midplane 24 and then bends upwardly and forwardly at a right angle to a position that is parallel with respect to the upper member of the respective lever.

Figure 5:
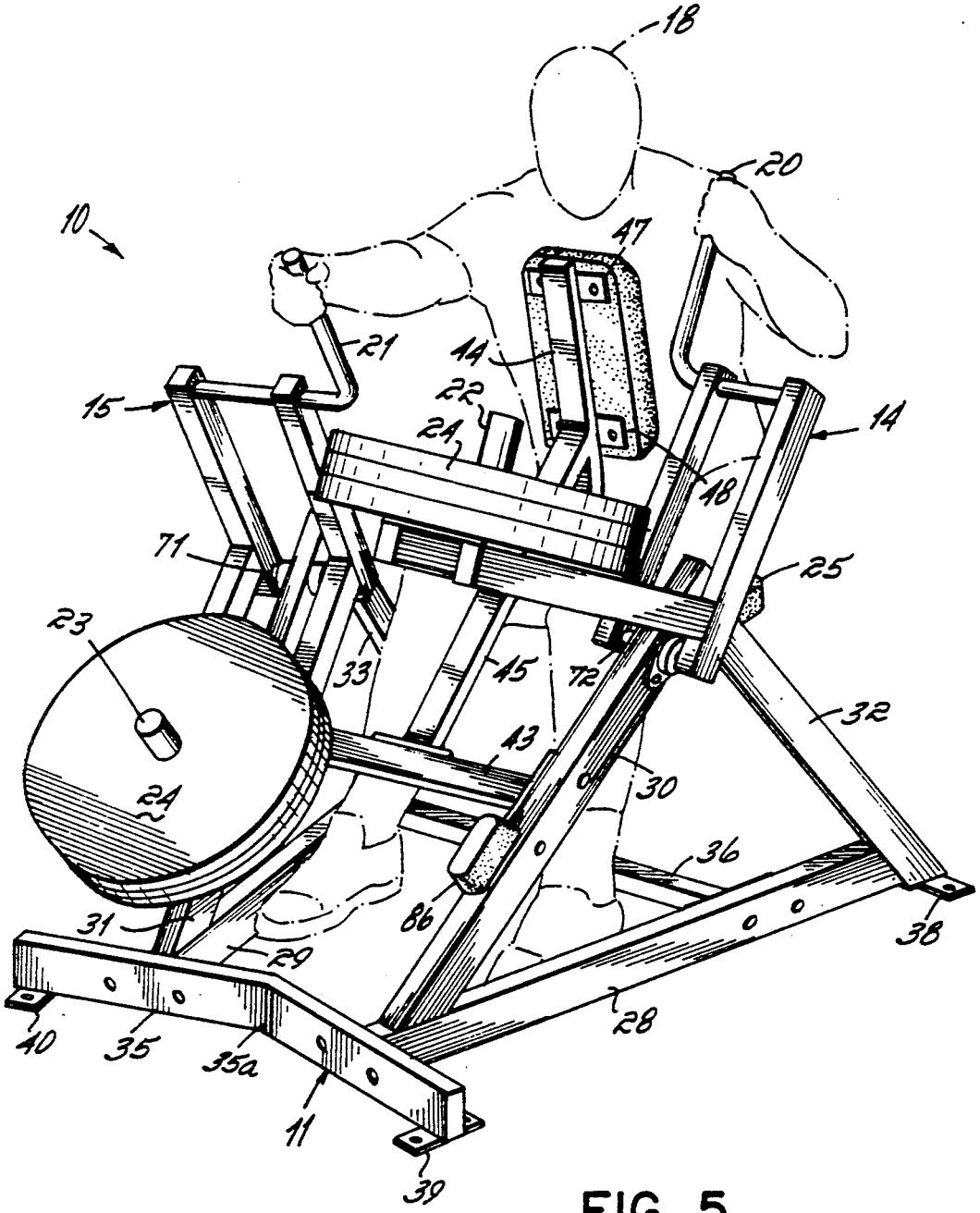
FIG. 5 is a perspective view of an alternative embodiment of the invention with an exerciser seated on the machine performing a rowing exercise.

FIG. 5 shows an earlier embodiment of the invention. According to this embodiment, each lever included a pair of connected upper and lower members. It was originally thought that the frame 10 would need this additional structural stability to handle the amount of weight that is typically lifted by larger athletes. Compared to the preferred embodiment shown in FIGS. 1-4, the sides of the frame of the machine shown in FIG. 5 converge at sharper angles. Moreover, the declined angle of the chest brace is closer to vertical. Subsequent refinements of the machine to its present structural form, as shown in FIGS. 1-4, resulted from feedback from athletes who used the machine.

While I have described a preferred embodiment of this invention, it is to be understood that the invention is not limited thereby and that in light of the present disclosure of the invention, various other alternative embodiments will be apparent to a person skilled in the art. For instance, the structural orientation of some parts of the frame 11 is not critical, so long as the positioning of the seat 25 and brace 26 with respect to the locations of the pivot points and the lever lengths and angles is maintained. Additionally, while the particular angles shown are considered to be optimum at this point in time, based upon feedback from those involved in strength training, it is entirely possible that some further refinements may evolve. Accordingly, it is to be understood that changes may be made without departing from the scope of the invention as particularly set forth and claimed.

I claim:

1. A rowing exercise machine comprising:

a frame;

a chest brace supported by the frame and centered longitudinally on a vertical midplane, the frame being longitudinally symmetrical with respect to the vertical midplane, and the chest brace adapted to support an exerciser facing a forward direction along the vertical midplane; and a pair of levers pivotally connected to the frame in front of the brace, each lever having a lower end adapted to support at least one removable weight and an upper end adapted to be grasped, with palms facing the midplane and thumbs pointed upwardly, and then pulled upwardly and rearwardly in a row motion along an outer vertical plane by an exerciser located on an opposite side of the brace, the levers being independently pivotal with respect to the frame and the outer vertical planes converging with respect to the forward facing direction.

2. The rowing exercise machine of claim 1 wherein each outer vertical plane converges at an angle of about 10° with respect to the forward facing direction.

3. The rowing exercise machine of claim 1 and further comprising:

a seat supported by the frame behind the chest brace.

4. The rowing exercise machine of claim 3 and further comprising:

means for selectively adjusting the vertical position of the seat.

5. The rowing exercise machine of claim 1 wherein the chest brace is inclined from the horizontal toward the front of the frame.

6. The rowing exercise machine of claim 1 wherein each lever further comprises:

an upper lever member pivotally connected to the frame at a pivot point located in front of the chest brace;

a lower lever member rigidly connected to the upper lever member adjacent the pivot point; and a handle connected to a top end of the upper lever member, the handle having a first section extending inwardly toward the vertical midplane and a second section extending parallel with the respective outer plane.

7. The rowing exercise machine of claim 6 wherein the upper and lower members of each of said levers are connected at an angle of about 90°.

8. The rowing exercise machine of claim 7 wherein the initial at rest position of the upper member is about 45° from vertical.

9. The rowing exercise machine of claim 6 wherein the initial at rest position of the lower member is about 45° from horizontal.

10. A rowing exercise machine comprising:

a frame;

a chest brace supported by the frame and centered on a longitudinal vertical midplane through the frame, the frame being longitudinally symmetrical with respect to the vertical midplane and the chest brace adapted to support an exerciser facing a forward direction along the vertical midplane; and a pair of levers pivotally connected to the frame in front of the brace, each lever having a lower end adapted to support at least one removable weight and an upper end adapted to be grasped, with palms facing the midplane and thumbs pointed upwardly, and then pulled upwardly and rearwardly in a row motion along an outer vertical plane by an exerciser located behind the brace, wherein the handles are a predetermined distance apart when the levers are in an initial, at rest position, and the outer vertical planes converge with respect to the forward facing direction so that the distance between the handles increases as the levers are pulled rearwardly.

11. A rowing exercise machine comprising:

a frame;

a seat supported by the frame and centered on a vertical midplane through the frame, the frame being longitudinally symmetrical with respect to the vertical midplane and the seat brace adapted to support an exerciser facing a forward direction along the midplane;

a chest brace connected to the frame in front of the seat; and a pair of levers pivotally connected to the frame in front of the seat, each lever having a lower end adapted to support at least one removable weight and an upper end adapted to be grasped, with palms facing the midplane and thumbs pointed upwardly, and then pulled upwardly and rearwardly in a row motion along an outer vertical plane by an exerciser supported on the seat behind the brace, each of the outer planes converging forwardly toward the vertical midplane.

12. The rowing exercise machine of claim 11 wherein each of the outer planes converges forwardly at an angle of about 10° with respect to the forward facing direction.

13. The rowing exercise machine of claim 11 wherein the frame further comprises:

a vertical upright to which the seat connects; and means for vertically adjusting the seat along the upright.

14. The rowing exercise machine of claim 11 wherein the chest brace is inclined from the horizontal toward the front of the frame.

15. The rowing exercise machine of claim 14 wherein the chest brace is inclined from horizontal at an angle of about 75°.

* * * * *